US007218334B2

(12) United States Patent
Otsuka

(10) Patent No.: US 7,218,334 B2
(45) Date of Patent: May 15, 2007

(54) PAPER OBJECT PROCESSING DEVICE AND PAPER OBJECT PROCESSING METHOD

(75) Inventor: Toru Otsuka, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 238 days.

(21) Appl. No.: 11/082,249

(22) Filed: Mar. 17, 2005

(65) Prior Publication Data

US 2005/0206710 A1 Sep. 22, 2005

(30) Foreign Application Priority Data

Mar. 19, 2004 (JP) ..... 2004-081568
Feb. 15, 2005 (JP) ..... 2005-038138

(51) Int. Cl.
*B41J 2/315* (2006.01)

(52) U.S. Cl. ..... 347/171

(58) Field of Classification Search ..... 347/171, 347/221, 211, 61, 71; 53/586, 588; 206/449
See application file for complete search history.

(56) References Cited

U.S. PATENT DOCUMENTS 4,540,614 A 9/1985 Omori
4,830,186 A * 5/1989 George et al. ..... 206/449
5,233,816 A * 8/1993 Moriya et al. ..... 53/588
5,369,419 A * 11/1994 Stephenson et al. ..... 347/61
5,434,596 A * 7/1995 Stephenson ..... 347/71
6,470,655 B1 * 10/2002 Schwede ..... 53/586
6,659,260 B2 12/2003 Otsuka et al.

FOREIGN PATENT DOCUMENTS

| | | |
|---|---|---|
| GB | 1 213 510 | 11/1970 |
| JP | 3-226429 | 10/1991 |
| JP | 5-124618 | 5/1993 |
| JP | 11-198915 | 7/1999 |
| JP | 2002-80012 | 3/2002 |
| JP | 2002-137862 | 5/2002 |
| JP | 2002-170146 | 6/2002 |

OTHER PUBLICATIONS

European Search Report dated Jul. 15, 2005 for Appln. No. 05006026.8-2308.

* cited by examiner

*Primary Examiner*—K. Feggins
(74) *Attorney, Agent, or Firm*—Pillsbury Winthrop Shaw Pittman, LLP

(57) ABSTRACT

The paper object processing device comprises a take-out roller which feeds tickets where one surface side is a heat-sensitive surface and the other surface side is a non heat-sensitive surface, a conveying path which conveys the fed ticket, a bar-code reader which reads the bar-code recorded on the heat-sensitive surface of the ticket conveyed, stacking sections which stack the tickets whose bar-codes have been read, a sealing device which seals a band on the stacked tickets which have been stacked, and a thermal head which heat-prints control information on the heat-sensitive surface of the stacked tickets which have been sealed.

9 Claims, 3 Drawing Sheets

PAPER OBJECT PROCESSING DEVICE AND PAPER OBJECT PROCESSING METHOD

CROSS-REFERENCE TO RELATED APPLICATIONS

This application is based upon and claims the benefit of priority from prior Japanese Patent Applications No. 2004-081568, filed Mar. 19, 2004; and No. 2005-038138, filed Feb. 15, 2005, the entire contents of both of which are incorporated herein by reference.

BACKGROUND OF THE INVENTION

1. Field of the Invention

The present invention relates to a paper object processing device and a paper object processing method for processing tickets for use in slot machines in American casinos, for example.

2. Description of the Related Art

Slot machines issue tickets which are used in place of the cash that is paid out. One surface side of this type of ticket is a heat-sensitive surface, and the 18 digit number is printed as information in the form of a bar-code and a number on the heat-sensitive surface using a thermal head, and the ticket is then issued.

In the case where the ticket is to be converted to cash, when the ticket is to be registered in the slot machine a second time, the ticket is inserted into the slot machine and the number is read by the bar-code reader and the cash amount that is registered in the host computer is referred to. The slot machine ticket reader generally has a paper currency reader installed at a shared location, and thus the used tickets are mixed with the paper currency when stored inside the storage safe.

It is to be noted that the tickets that are stored in the storage safe are taken out together with the cash but a processing device for stacking and sealing tickets is being developed in which the tickets that are taken out are separated from the cash.

In the case of American casinos, there is a requirement to keep the used tickets for a few years, and as a result, bundles of 100 are sealed using a banding material as is done with paper currency. If sufficient information is not written on each bundle, it will be difficult to find it later, and thus control information is written on the banding material.

Furthermore, as disclosed in Jpn. Pat. Appln. KOKAI Publication No. 2002-80012, the banding material is wrapped around the tickets and both ends thereof are overlapped and a heater head is pressed on to both ends that have been overlapped, and heat-sealing is thereby performed.

However, in the prior art, there is a problem in that sufficient control information could not be recorded because the banding material on which the control information is written is not wide enough and is thus limited in area.

Furthermore, in the prior art, because the heater head is pressed on both overlapped ends of the banding material at the heat-sensitive surface of the ticket, there is a problem at the time of heat-sealing in that the heat-sensitive surface of the ticket is heated by the heat from the heater head and it may be blackened.

BRIEF SUMMARY OF THE INVENTION

One aspect of this invention has been conceived in view of the above-described situation and an object thereof is to provide a paper object processing device and a paper object processing method in which a sufficient amount of control information can be recorded, and when the bundling material is heat sealed, heat is not directly applied to the heat-sensitive surface side of the ticket.

A paper object processing apparatus according to one aspect of the present invention comprises: a feeding device which feeds a paper object in which one surface side is a heat-sensitive surface having information recorded thereon and the other surface side is a non heat-sensitive surface; a conveying device which conveys the paper object fed from the feeding device; a reading device which reads the information recorded on the heat-sensitive surface of the paper object that is conveyed by the conveying device; stacking devices which stack the paper objects whose information has been read by the reading device; a bundling device which bundles by wrapping the bundling material around the stacked paper objects stacked by the stacking devices; and a heat-recording device which heat records control information on the heat-sensitive surface of the stacked paper objects bundled by the bundling device.

A paper object processing apparatus according to another aspect of the present invention comprises: a feeding device which feeds a paper object in which one surface side is a heat-sensitive surface having information recorded thereon and the other surface side is a non heat-sensitive surface; a conveying device which conveys the paper object fed from the feeding device; a reading device which reads the information recorded on the heat-sensitive surface of the paper object that is conveyed by the conveying device; aligning devices which align back and front and vice versa for the paper object based on information read by the reading device; stacking devices which stack the paper objects whose front and back and vice versa have been aligned by the aligning devices; a winding device which winds the bundling material around the outer periphery of the stacked paper objects stacked at the stacking devices and overlaps both ends at the non heat-sensitive surface side of the stacked paper objects; and a heat-sealing device which heat-seals by pressing the heater head on both overlapped ends of the bundling material which is wound by the winding device and which is positioned at the non heat-sensitive surface side of the stacked paper objects.

A paper object processing apparatus according to another aspect of the present invention comprises: a feeding device which feeds a paper object in which one surface side is a heat-sensitive surface having information recorded thereon and the other surface side is a non heat-sensitive surface; a conveying device which conveys the paper object fed from the feeding device; a reading device which reads the information recorded on the heat-sensitive surface of the paper object that is conveyed by the conveying device; aligning devices which align back and front and vice versa for the paper object based on the information read by the reading device; stacking devices which stack the paper objects whose front and back and vice versa have been aligned by the aligning devices; a winding device which winds the bundling material around the outer periphery of the stacked paper objects stacked at the stacking devices and overlaps both ends at the non heat-sensitive surface side of the stacked paper objects; a heat-sealing device which heat-seals by pressing the heater head on both overlapped ends of the bundling material which is wound by the winding device and which is positioned at the non heat-sensitive surface side of the stacked paper objects; and a heat-recording device which heat-records control information on the heat-sensitive surface of the stacked paper objects.

A paper object processing apparatus according to another aspect of the present invention comprises: a feeding device which feeds a paper object in which one surface side is a heat-sensitive surface having information recorded thereon and the other surface side is a non heat-sensitive surface; a conveying device which conveys the paper object fed from the feeding device; a reading device which reads the information recorded on the heat-sensitive surface of the paper object that is conveyed by the conveying device; aligning devices which align back and front and vice versa for the paper object based on the information read by the reading device; stacking devices which stack the paper objects whose front and back and vice versa have been aligned by the aligning devices; a winding device which winds the bundling material around the outer periphery of portion of the stacked paper objects stacked at the stacking devices where there is no information recorded and overlaps both ends at the non heat-sensitive surface side of the stacked paper objects; and a heat-sealing device which heat-seals by pressing the heater head on both overlapped ends of the bundling material which is wound by the winding device and which is positioned at the non heat-sensitive surface side of the stacked paper objects.

A paper object processing apparatus according to another aspect of the present invention comprises: a feeding device which feeds a paper object in which one surface side is a heat-sensitive surface having information recorded thereon and the other surface side is a non heat-sensitive surface; a conveying device which conveys the paper object fed from the feeding device; a reading device which reads the information recorded on the heat-sensitive surface of the paper object that is conveyed by the conveying device; aligning devices which align front and back and vice versa for the paper object based on the information read by the reading device; stacking devices which stacking the paper objects whose front and back and vice versa have been aligned by the aligning devices; a winding device which winds the bundling material around the outer periphery of the stacked paper objects stacked at the stacking devices and overlaps both ends at the non heat-sensitive surface side of the stacked paper objects; a heat-sealing device which heat-seals by pressing the heater head on both overlapped ends of the bundling material which is wound by the winding device and which is positioned at the non heat-sensitive surface side of the stacked paper objects; and a control device which controls the heating temperature of the heater head.

A paper object processing apparatus according to another aspect of the present invention comprises: a feeding device which feeds a paper object in which one surface side is a heat-sensitive surface having information recorded thereon and the other surface side is a non heat-sensitive surface; a conveying device which conveys the paper object fed from the feeding device; a reading device which reads the information recorded on the heat-sensitive surface of the paper object that is conveyed by the conveying device; aligning devices which align back and front and vice versa for the paper object based on the information read by the reading device; stacking devices which stack the paper objects whose front and back and vice versa have been aligned by the aligning devices; a winding device which winds the bundling material around the outer periphery of the stacked paper objects stacked at the stacking devices and overlaps both ends at the non heat-sensitive surface side of the stacked paper objects; a heat-sealing device which heat-seals by pressing the heater head on both overlapped ends of the bundling material which is wound by the winding device and which is positioned at the non heat-sensitive surface side of the stacked paper objects; and a control device which controls the pressing time for the heater head on both overlapped ends of the bundling material.

A paper object processing apparatus according to another aspect of the present invention comprises: a receiving device which receives a paper object in which one surface side has a heat-sensitive surface and the other surface side has a non heat-sensitive surface, and on which information is recorded on the heat-sensitive surface inside the slot machine and which is discharged from the slot machine; a feeding device which feeds the paper object received at the receiving device; a conveying device which conveys the paper object fed from the feeding device; a reading device which reads the information recorded on the heat-sensitive surface of the paper object that is conveyed by the conveying device; aligning devices which align front and back and vice versa for the paper object based on the information read by the reading device; stacking devices which stack the paper objects whose front and back and vice versa have been aligned by the aligning devices; a transport device which transports the paper objects stacked at the stacking devices to the bundling position; a winding device which winds the binding material around the outer periphery of the stacked paper objects that have been transported to the bundling position by transport device, at a portion where there is no information recorded and overlapping both ends at the non heat-sensitive surface side of the stacked paper objects; a heat-sealing device which heat-seals by pressing the heater head on both overlapped ends of the bundling material which is wound by the winding device and which is positioned at the non heat-sensitive surface side of the stacked paper objects; a heat-recording device which heat-records control information on the heat-sensitive surface of the stacked paper objects which have been transported to the bundling position; and control devices which control the heating temperature of the heater head on both overlapped ends of the bundling material and the pressing time.

A paper object processing method according to another aspect of the present invention comprises: feeding a paper object in which one surface side is a heat-sensitive surface having information recorded thereon and the other surface side is a non heat-sensitive surface; conveying the fed paper object; reading the information recorded on the heat-sensitive surface of the conveyed paper object; aligning back and front and vice versa for the paper object based on the read information; stacking the paper objects whose front and back and vice versa have been aligned; winding the bundling material around the outer periphery of the stacked paper objects at a portion where no information is recorded and overlapping both ends at the non heat-sensitive surface side of the stacked paper objects; and heat-sealing by pressing the heater head on both overlapped ends of the bundling material positioned at the non heat-sensitive surface side of the stacked paper objects by the winding.

According to this invention, a large amount of control information can be recorded for the paper objects, and when the bundling material is being heat-sealed, blackening of the heat-sensitive surface side of the paper object due to heating is, as far as possible, prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
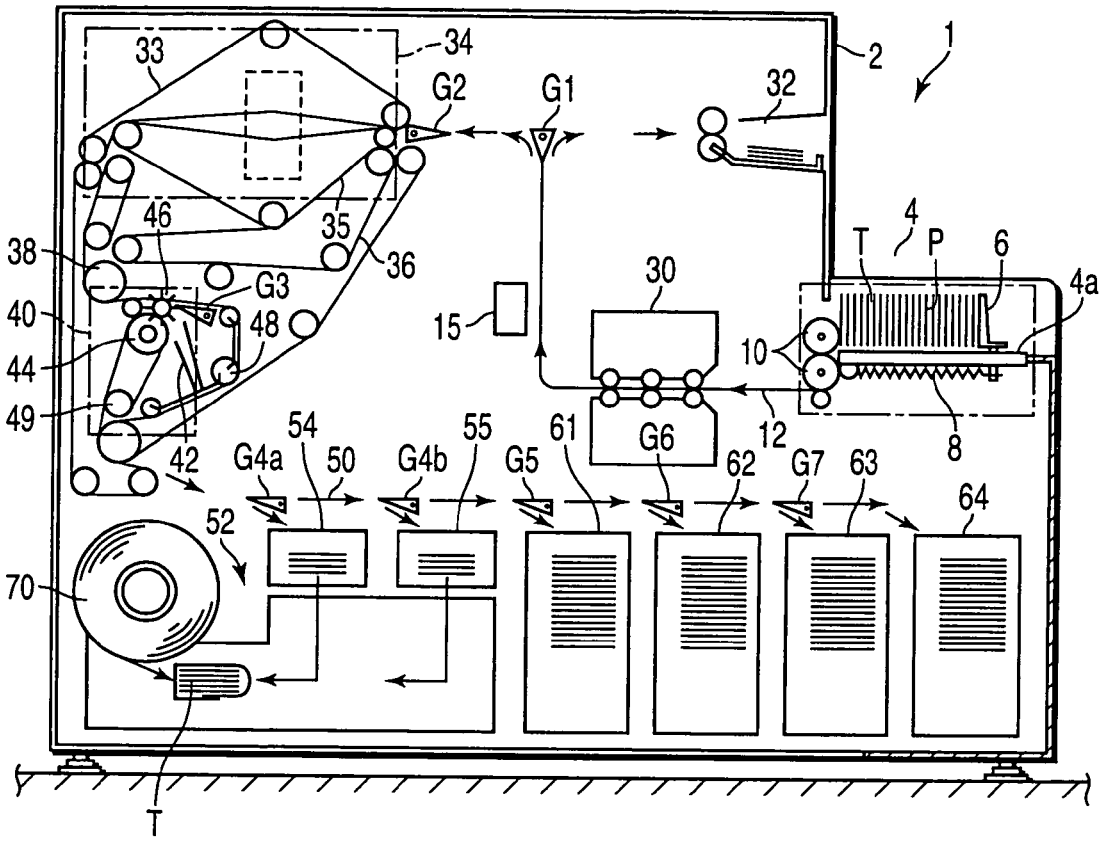
FIG. 1 is a schematic view of an internal structure of a paper object processing apparatus according to a first embodiment of the invention.

The following is a detailed description of the invention with reference to embodiments shown in the drawings.

FIG. 1 is a schematic view of the internal structure of a paper object processing apparatus 1 according to a first embodiment of the invention.

The paper object processing apparatus 1 is one in which tickets and various denominations of paper currency are inserted together in a game machine such as a slot machine in mixed state, and the tickets and the paper currency are stacked separately and the tickets are sealed in bundles of a prescribed number (for example, 100 pieces).

The paper object processing apparatus 1 is has a cabinet 2, and one side portion of the cabinet 2 has an insertion section 4 as a receiving device into which the tickets T and the paper currency P are inserted together in an upright state as the plurality of paper objects. The insertion section 4 comprises a stage 4*a* for contacting and leveling the lower end surface of the tickets T and paper currency P. A backup plate 6 which is erected in the perpendicular direction at one side of the stage 4*a* is provided so as to be moveable in the stacking direction of the tickets T and the paper currency P. The backup plate 6 is urged in the left direction of the drawing along the stage 4 by the urging force of the spring 8.

The other side of the stage 4*a* has a pair of take-out rollers 10 as the feeding device. The plurality of tickets T and the paper currency P which have been inserted in the insertion section 4 in an upright state are taken out sequentially starting with those at front end. They are taken out due to the rotation of the take-out rollers 10 onto the conveyance path 12.

The conveyance path 12 has a detector 30 which detects features of the paper currency P such as the denomination, the front and back, the top and bottom, whether it is dirty or is torn and the like. The detector 30 reads various types of information from the surface of the paper currency P which is conveyed along the conveyance path 12 and the read information, and the information that is read is subjected to logical computation and detects the features of the paper currency which are listed above by comparison with reference information.

Figure 2:
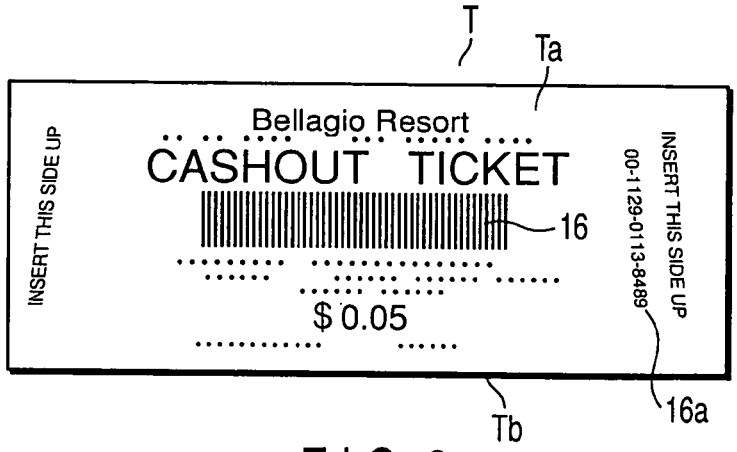
FIG. 2 is a plan view of a ticket that is processed at the paper object processing apparatus.

A bar-code reader 15 which is the reading device is provided on the conveyance path 12 which is provided at the downstream side of the detector 30. The bar-code reader 15 reads the 18 digit number that is recorded on the ticket T. As shown in FIG. 2, the 18 digit number includes the bar-code 16 and the number 16*a* as the information. One surface side of the ticket T is a heat-sensitive surface Ta, while the other surface side is a non heat-sensitive surface Tb. The bar-code 16 and the number 16*a* is printed on heat-sensitive surface Ta of the ticket T when it is issued by the slot machine using a thermal head or the like.

There is a plurality of gates G1–G7 for selectively switching the conveyance direction of the ticket T and the paper currency P based on the detection results of the detector 30 at the downstream side in the conveyance direction of the ticket T and the paper currency P of the bar-code reader 15.

In the case where the bar-code 16 of ticket T has not been read by the bar-code reader 15, the ticket is conveyed to the right direction in the drawing via the gate G1, and discharged to the reject box 32.

In the detector 30, in the case where 2 sheets are taken for the paper currency, or it is determined that the paper currency is skewed to exceed a prescribed level by a large amount, or a losing ticket which is not determined as a regular ticket which can circulate again or a counterfeit ticket, in other words, paper currency that has been determined to be paper currency that can not be processed in the following process, it is conveyed towards the right direction in the drawing via the gate G1, and discharged to the reject box 32. The reject box 32 may be accessed from outside the cabinet 2 of the paper object processing apparatus 1.

Meanwhile, the ticket T whose bar-code 16 has been read in the bar-code reader 15 and the paper currency P that has been determined to be normal paper currency that can be processed at the detector 30 are conveyed to the left direction in the drawing to the gate G2 via the gate G1.

The back and front and top and bottom of the paper currency P which is in the direction of the gate G2 are not uniform as described above. The direction for the back and front and top and bottom of the paper currency P whose back and front and top and bottom are not uniform are selectively aligned using the processing mechanisms described hereinafter which are at the downstream side of gate G2 and the paper currency is classified and stacked by denomination.

Also the front and back of all the tickets T which are in the direction of gate G2 are reversed using the processing mechanisms described hereinafter which are at the downstream side of gate G2, and the top and bottom are selectively aligned and stacked.

The conveyance path which is at the downstream side of the gate G2 is branched in 2 directions and the conveyance path of the paper currency P is selectively switched in the 2 directions by the switching of the gate G2, and the ticket T is guided only in one direction (the direction of the front and back reversing mechanism 34 as described below).

One direction of the conveyance path which branches at the downstream side of the gate G2 has the front and back reversing mechanism 34 as an aligning device for reversing the back and front of the paper currency P. The conveyance path which passes the front and back reversing mechanism 34 has a twisting conveyance path which is rotated by 180° around the center axis from the entrance towards the exit. In addition, there are 2 pairs of conveyor belts 33 and 35 which face each other along the twisting conveyance path. The other conveyance path which is branched at the downstream side of the gate G2 is the conveyance path 36 which is just simply for passing the paper currency P.

The ticket T or the paper currency P which passes the front and back reversing mechanism 34 and whose front and back have been reversed, and the paper currency P which has passed the conveyance path 36 are both sent to the gate G3 via the merging section 38.

The conveyance path at the downstream side of the gate G3 is branched in 2 directions and the conveyance path of the paper currency P is selectively switched in the 2 directions by the switching of the gate G3.

One conveyance path that is branched at the downstream side of the gate G3 has a top and bottom reversing mechanism 40 as the aligning device for aligning the top and bottom of the ticket T or the paper currency P. The top and bottom reversing mechanism 40 has a switchback section 42 which temporarily stores the ticket T or the paper currency P sent in via the gate G3; reversal rollers 44 which are disposed adjacent to the switchback section 42 for taking out ticket T or the paper currency P conveyed into the switchback section 42 in the reverse direction by the rear end side thereof; and a printing wheel 46 for pressing the rear end of the ticket T or the paper currency P conveyed into the switchback section 42 to the reversal rollers 44 and generating a conveyance force for the ticket T or the paper currency P.

The ticket T or the paper currency P that has been sent into the top and bottom reversing mechanism 40 via the gate G3 is temporarily stored in the switchback section 42 with the front end side that is in the conveyance direction thereof at the bottom, and the rear end that is in the conveyance direction is pressed by the reversal roller 44 due to swinging of the printing wheel 46. As a result, the ticket T or the paper currency P which is stored in the switchback section 42 is taken out in the reverse direction such that the rear end side is at the front due to the rotation of the reversal roller 44. Consequently, the conveyance direction of the tickets T and the paper currency P are reversed and the bottom and top are reversed.

Furthermore, the other conveyance path which is branched at the downstream side of the gate G3 forms the conveyance path 48 which just simply causes the paper currency P to pass. The ticket T or the paper currency P which passed the top and bottom reversing mechanism 40, and ticket T or the paper currency P which has passed the conveyance path 48 are both sent to the gate G4 via the merging section 49.

The conveyance path at the downstream side of the top and bottom reversing mechanism 40 forms a horizontal conveyance path 50 which extends horizontally above a plurality of stacking sections. 5 gates G4*a* to G7 are formed above the horizontal conveyance path 50.

The branch positions due to the gates G4*a* and 4*b* which are most upstream have a sealing device 52 for stacking, for example, 100 pieces of the ticket T and using the band k as a bundling material and sealing to form bundles of the tickets. The sealing device 52 is described in detail hereinafter. The bundle of the tickets T that have been sealed in quantities of a prescribed number by the sealing device 52 is conveyed to the outside of the device via a conveyor which is not shown.

Meanwhile, the branch positions due to the three gates G5, G6 and G7 which are at the downstream side of gate G4*b* along the horizontal conveyance path 50 have 4 stacking sections 61, 62, 63 and 64. The amount of stacking sections is 1 more than the number of gates. The paper currency P which is selectively separated by the gate G5 is stacked in the stacking section 61, and the paper currency P which is selectively separated by the gate G6 is stacked in the stacking section 62, and the paper currency P which is selectively separated by the gate G7 is stacked in the stacking section 63 or 64.

Figure 3:
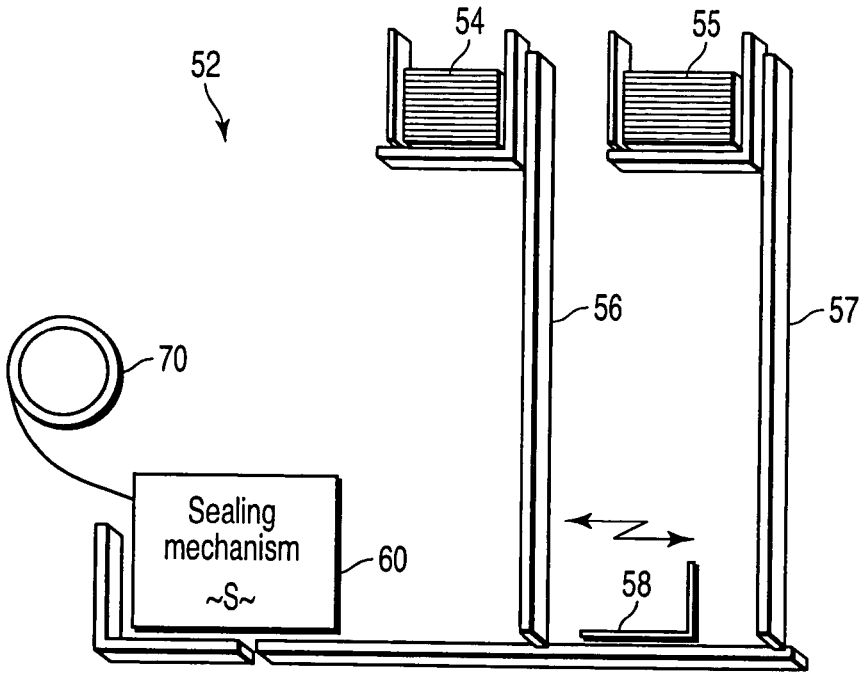
FIG. 3 is a perspective view of a sealing device for the ticket.

FIG. 3 is a structural drawing of the sealing device 52.

The sealing device 52 comprises first and second stacking devices 54 and 55 as stacking devices for stacking the tickets T that have been selectively sent in via the gates G4*a* and G4*b*. The front and back of tickets T that have been stacked by the first and second stacking devices 54 and 55 are reversed by the above-described front and back reversing mechanism 34 and they are thereby stacked such that the heat-sensitive surface Ta thereof faces upwards, and the non heat-sensitive surface Tb is downwards.

As a result, as described below, when the stacked tickets T move to the sealing position S, the non heat-sensitive surface Tb faces the heater head 25.

Also because the top and bottom of the tickets T are reversed by the top and bottom reversing mechanism 40, one end side of the heat-sensitive surface Ta on which the numerical information 16 is recorded is positioned at the back side of the stacking sections 54 and 55 and the other end side on which no useful information is recorded is positioned at the front side of the stacking sections 54 and 55.

As a result, as described below, when the stacked ticket T moves to the sealing position S, the other end side which does not have useful information recorded thereon faces the heater head 25.

The first and second stacking devices 54 and 55 are moved vertically by the first and second vertical conveying mechanisms 56 and 57 which are the moving devices. The lower sides of the first and second vertical conveying mechanisms 56 and 57 have a conveyance carrier 58 as the transport device which receives the stacked tickets T from the first or second stacking devices 54 and 55 and transports them as is with the heat-sensitive surface Ta side upwards to the sealing position S which is the bundling position.

The sealing position S has a sealing mechanism 60 as the bundling device which seals the stacked tickets that have been transported, and the sealing mechanism 60 has a band feeding section 70 for feeding the band k which is the bundling material to the diagonal upper part of the sealing mechanism 60. The band k is coated with adhesive and may be sealed by heat.

Figure 4:
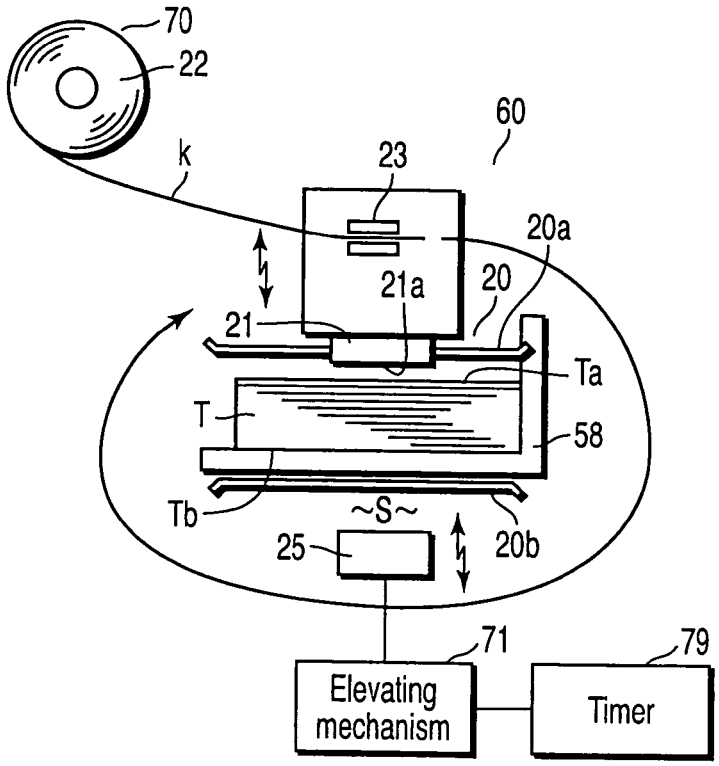
FIG. 4 shows a configuration of a sealing mechanism section.

FIG. 4 is a structural view of the sealing mechanism 60 and the band feeding section 70.

The sealing mechanism 60 has a damper 20 and the damper 20 has upper and lower clamp pieces 20*a* and 20*b*, and the clamp pieces 20*a* and 20*b* are moveable towards and away from each other. The upper side clamp piece 20*a* has a thermal head 21 as the heat recording device. In the thermal head 21, the upper side clamp piece 20*a* moves downward and the heat generating surface 21*a* thereby contacts the heat-sensitive surface Ta of the ticket T. Furthermore, the control information is heat-recorded and printed due to the mechanical fixing.

Furthermore, the lower part of the lower side clamp piece 20*b* has a heater head 25 as the heat-sealing device. The heater head 25 is at the non heat-sensitive surface Tb side of the ticket T and faces the other end side where no useful information is recorded. The heater head 25 is moved upwards and downwards by an elevating mechanism 71 and contacts and separates from both ends of the band k which are overlapped at the non heat-sensitive surface Tb of the ticket T.

The band feeding section 70 comprises a reel section 22 for paying out the band k and a nipping section 23 as a winding device which nips the ends of the band k that is paid out from the reel section 22 and moves along the outer circumferential portion of the other end side of the stacked ticket T where no useful information is recorded.

Next the sealing operation of the sealing device 52 will be described.

Figure 6:
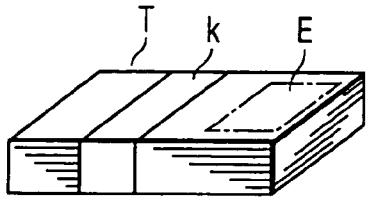
FIG. 6 is a perspective view showing a print area for control information on a heat-sensitive surface of the ticket stack.

As described above, the conveying carrier 58 which receives the stacked tickets T moves to the sealing position S, and as a result the stacked tickets T are introduced between the upper and lower clamp pieces 20*a* and 20*b* as shown in FIG. 4. After this introduction occurs, the upper and lower clamp pieces 20*a* and 20*b* move in a direction so as to approach each other and the stacked tickets T are thereby nipped and held. At this time, the heat generating surface 21*a* of the thermal head 21 of the upper side clamp piece 20*a*, is pressed on the area E of the heat-sensitive surface Ta of the tickets T as shown in FIG. 6. Control information such as date, time, operator number, name, the number of the slot machine used by the set of tickets, number and name slot machine group, serial number and the like are printed in the area E.

Figure 5:
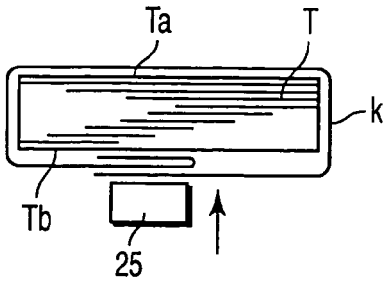
FIG. 5 shows a state in which overlapped ends of a band that is wrapped around a ticket stack at the sealing mechanism section is heated by a heater head.
Figure 7:
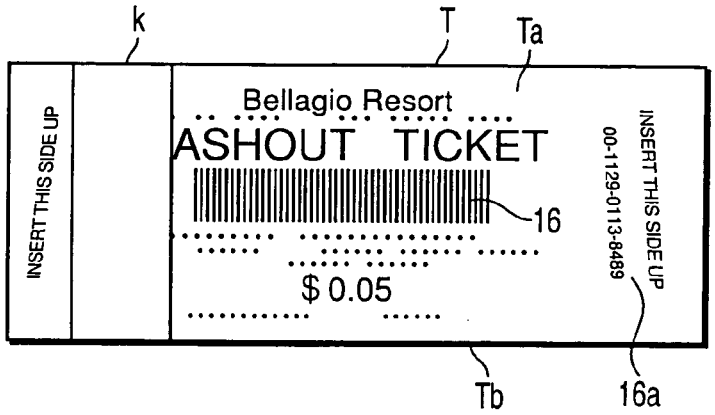
FIG. 7 is a plan view of a state in which a band is wrapped around an outer peripheral portion which does not have useful information of the ticket stack.

Furthermore, after the stacked tickets T are nipped and held by the upper and lower clamp pieces 20*a* and 20*b*, the nipping portion 23 which nips the front end of the band k moves along the outer periphery of the portion of the ticket T on which no useful information is recorded. As a result, as shown in FIG. 7, the band k is wrapped around the outer periphery of the portion of the tickets T that have no useful information recorded thereon. Both ends of the band k are overlapped at the non heat-sensitive surface Tb of the stacked tickets T as shown in FIG. 5. The heater head 25 is moved upwards and both overlapped ends of the band k are pressed and heat is applied to heat-seal the band k and thereby complete bundling.

As described above, according to this embodiment, because the thermal head 21 is pressed onto the heat-sensitive surface Ta of the stacked tickets T transported to the sealing position S and the control information is printed, the printing area is wider than the case of printing the control information on the band k in the prior art and a larger amount of control information can be printed.

Also, because the thermal head 21 has the clamp piece 20*a* attached, the thermal head 21 can be pressed onto the heat-sensitive surface Ta of the tickets T based on the movement of the clamp piece 20*a*. Thus, a special driving mechanism for moving the thermal head 21 is not necessary and the structure is thereby simplified.

Furthermore, because the top and bottom reversing mechanism 40 is loaded in this device, the path can be determined based on reversing information determined by the detector 30, and the tickets can always be stacked in the same direction. Accordingly, print position of the information on the upper surface of the ticket T can be uniform and when the tickets in the bundle are being checked, direction of the tickets are all the same and this provides added convenience.

Also, because after the bar-code 16 that is on the heat-sensitive surface Ta of the ticket T is read by the bar-code reader 15, the back and front of all the tickets T are reversed by the front and back reversing mechanism 34 and then stacked in the stacking sections 54 and 55 with the non heat-sensitive surface Tb facing downward, when the stacked tickets T which are stacked in the stacking sections 54 and 55 are transported to the sealing position, the non heat-sensitive surface Tb side faces the heater head 25.

Accordingly, both overlapped ends of the band k can be heat sealed at the non heat-sensitive surface Tb side of the stacked tickets T, and the heater head 25 does not directly contact the heat-sensitive surface Ta of the tickets T and blackening of the heat-sensitive surface Ta due to being heated can be completely prevented.

It is to be noted that even when the band k is heat-sealed at the non heat-sensitive surface Tb side, in the case where the band k is wrapped around the outer periphery where useful information is recorded, there is the possibility that the useful information may become blackened due to heating.

Thus, in this embodiment, the band k is wound along the outer periphery of the portion of the stacked tickets T where there is no useful information recorded. As a result, the band k can be heat-sealed while avoiding the portions of the stacked tickets T where useful information is recorded and the useful information on the stacked tickets T will not be blackened due to heating.

In addition, the paper currency is easily damaged due to being passed and when stacked the paper currency tends to bulk up. For this reason there is a tendency to use high tension on the band for bundling the stacked paper currency. Accordingly, even if the frequency of repeated use of the tickets is low and they are stacked, the tickets are unlikely to bulk up. Thus the heating temperature for heat-sealing the ticket band may be lower than the temperature for heat-sealing the paper currency.

As a result, in this embodiment, the heating temperature of the heater head is variably controlled for the ticket and for the paper currency.

Figure 8:
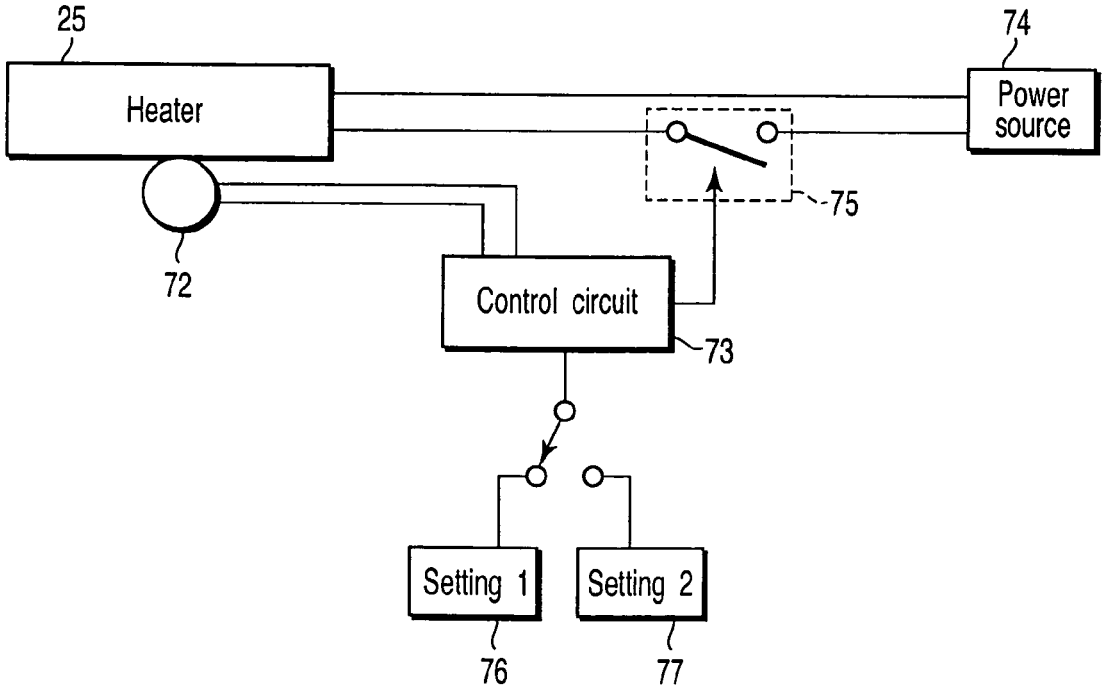
FIG. 8 is a diagram showing a heat control circuit of the heater head.

FIG. 8 is a block diagram showing a control system for the heating temperature of the heater head 25.

A thermistor 72 is attached to the heater head 25 as a temperature sensor and the thermistor 72 is connected to the relay 75 of the power supply circuit 74 via the control circuit 73. First and second temperature setting sections 76 and 77 are connected to the control circuit 73.

The temperature of the heater head 25 is detected by the thermistor 72 and the detected temperature is compared with the temperature set at the first and second temperature setting sections 76 and 77. The relay 75 is interrupted in accordance with the compared value and the heating current is turned on and off to thereby control the temperature of the heater head 25.

The first temperature setting section 76 may, for example, set the heating temperature of the heater head 25 at the time of sealing the paper currency, and this temperature may be set to, for example, 200° C. The second temperature setting section 77 may, for example, set the heating temperature of the heater head 25 at the time of sealing the tickets, and this temperature may be set to, for example, 160° C.

In addition, the heater head 25 is elevated by an elevating mechanism 71 as shown in FIG. 4, and is pressed onto both overlapped ends of the band k, but the pressing time or in other words the heating time is controlled by the setting of the timer 79.

For example, in the case where the heating temperature of the heater head 25 is set to 200° C. when sealing the paper currency using the first temperature setting section 76, the heating time is set to 2 seconds. In the case where the heating temperature of the heater head 25 is set to 160° C. when sealing the tickets using the second temperature setting section 77, the heating time is set to 2 seconds or 4 seconds.

It is to be noted that if the heating temperature of the heater head 25 is set to 200° C. which the same for paper currency sealing, when sealing the tickets using the second temperature setting section 77, the heating time will be set to half of the time for sealing the paper currency or in other words, 1 second.

In this manner, by controlling the heating temperature of the heater head 25 when sealing tickets as well as the heating time, both overlapped ends of the band k are not unnecessarily overheated and prevention of blackening due to heating of the heat-sensitive surface Ta side of the tickets T can be further ensured.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper object processing apparatus comprising:

a feeding device which feeds a paper object in which one surface side is a heat-sensitive surface having information recorded thereon and the other surface side is a non heat-sensitive surface;

a conveying device which conveys the paper object fed from the feeding device;

a reading device which reads the information recorded on the heat-sensitive surface of the paper object that is conveyed by the conveying device;

stacking devices which stack the paper objects whose information has been read by the reading device;

a bundling device which bundles by wrapping the bundling material around the stacked paper objects stacked by the stacking devices; and a heat-recording device which heat records control information on the heat-sensitive surface of the stacked paper objects bundled by the bundling device.

2. The paper object processing apparatus according to claim 1, wherein the bundling device has clamps which nip and hold the stacked paper objects, and the heat-recording device is attached to the clamp, and is pressed on the heat-sensitive surface of the stacked paper objects based on the nipping action of the clamps.

3. A paper object processing apparatus comprising:

a feeding device which feeds a paper object in which one surface side is a heat-sensitive surface having information recorded thereon and the other surface side is a non heat-sensitive surface;

a conveying device which conveys the paper object fed from the feeding device;

a reading device which reads the information recorded on the heat-sensitive surface of the paper object that is conveyed by the conveying device;

aligning devices which align back and front and vice versa for the paper object based on information read by the reading device;

stacking devices which stack the paper objects whose front and back and vice versa have been aligned by the aligning devices;

a winding device which winds the bundling material around the outer periphery of the stacked paper objects stacked at the stacking devices and overlaps both ends at the non heat-sensitive surface side of the stacked paper objects; and a heat-sealing device which heat-seals by pressing the heater head on both overlapped ends of the bundling material which is wound by the winding device and which is positioned at the non heat-sensitive surface side of the stacked paper objects.

4. A paper object processing apparatus comprising:

a feeding device which feeds a paper object in which one surface side is a heat-sensitive surface having information recorded thereon and the other surface side is a non heat-sensitive surface;

a conveying device which conveys the paper object fed from the feeding device;

a reading device which reads the information recorded on the heat-sensitive surface of the paper object that is conveyed by the conveying device;

aligning devices which align back and front and vice versa for the paper object based on the information read by the reading device;

stacking devices which stack the paper objects whose front and back and vice versa have been aligned by the aligning devices;

a winding device which winds the bundling material around the outer periphery of the stacked paper objects stacked at the stacking devices and overlaps both ends at the non heat-sensitive surface side of the stacked paper objects;

a heat-sealing device which heat-seals by pressing the heater head on both overlapped ends of the bundling material which is wound by the winding device and which is positioned at the non heat-sensitive surface side of the stacked paper objects; and a heat-recording device which heat-records control information on the heat-sensitive surface of the stacked paper objects.

5. A paper object processing apparatus comprising:

a feeding device which feeds a paper object in which one surface side is a heat-sensitive surface having information recorded thereon and the other surface side is a non heat-sensitive surface;

a conveying device which conveys the paper object fed from the feeding device;

a reading device which reads the information recorded on the heat-sensitive surface of the paper object that is conveyed by the conveying device;

aligning devices which align back and front and vice versa for the paper object based on the information read by the reading device;

stacking devices which stack the paper objects whose front and back and vice versa have been aligned by the aligning devices;

a winding device which winds the bundling material around the outer periphery of portion of the stacked paper objects stacked at the stacking devices where there is no information recorded and overlaps both ends at the non heat-sensitive surface side of the stacked paper objects; and a heat-sealing device which heat-seals by pressing the heater head on both overlapped ends of the bundling material which is wound by the winding device and which is positioned at the non heat-sensitive surface side of the stacked paper objects.

6. A paper object processing apparatus comprising:

a feeding device which feeds a paper object in which one surface side is a heat-sensitive surface having information recorded thereon and the other surface side is a non heat-sensitive surface;

a conveying device which conveys the paper object fed from the feeding device;

a reading device which reads the information recorded on the heat-sensitive surface of the paper object that is conveyed by the conveying device;

aligning devices which align front and back and vice versa for the paper object based on the information read by the reading device;

stacking devices which stacking the paper objects whose front and back and vice versa have been aligned by the aligning devices;

a winding device which winds the bundling material around the outer periphery of the stacked paper objects stacked at the stacking devices and overlaps both ends at the non heat-sensitive surface side of the stacked paper objects;

a heat-sealing device which heat-seals by pressing the heater head on both overlapped ends of the bundling material which is wound by the winding device and which is positioned at the non heat-sensitive surface side of the stacked paper objects; and a control device which controls the heating temperature of the heater head.

7. A paper object processing apparatus comprising:

a feeding device which feeds a paper object in which one surface side is a heat-sensitive surface having information recorded thereon and the other surface side is a non heat-sensitive surface;

a conveying device which conveys the paper object fed from the feeding device;

a reading device which reads the information recorded on the heat-sensitive surface of the paper object that is conveyed by the conveying device;

aligning devices which align back and front and vice versa for the paper object based on the information read by the reading device;

stacking devices which stack the paper objects whose front and back and vice versa have been aligned by the aligning devices;

a winding device which winds the bundling material around the outer periphery of the stacked paper objects stacked at the stacking devices and overlaps both ends at the non heat-sensitive surface side of the stacked paper objects;

a heat-sealing device which heat-seals by pressing the heater head on both overlapped ends of the bundling material which is wound by the winding device and which is positioned at the non heat-sensitive surface side of the stacked paper objects; and a control device which controls the pressing time for the heater head on both overlapped ends of the bundling material.

8. A paper object processing apparatus comprising:

a receiving device which receives a paper object in which one surface side has a heat-sensitive surface and the other surface side has a non heat-sensitive surface, and on which information is recorded on the heat-sensitive surface inside the slot machine and which is discharged from the slot machine;

a feeding device which feeds the paper object received at the receiving device;

a conveying device which conveys the paper object fed from the feeding device;

a reading device which reads the information recorded on the heat-sensitive surface of the paper object that is conveyed by the conveying device;

aligning devices which align front and back and vice versa for the paper object based on the information read by the reading device;

stacking devices which stack the paper objects whose front and back and vice versa have been aligned by the aligning devices;

a transport device which transports the paper objects stacked at the stacking devices to the bundling position;

a winding device which winds the binding material around the outer periphery of the stacked paper objects that have been transported to the bundling position by transport device, at a portion where there is no information recorded and overlapping both ends at the non heat-sensitive surface side of the stacked paper objects;

a heat-sealing device which heat-seals by pressing the heater head on both overlapped ends of the bundling material which is wound by the winding device and which is positioned at the non heat-sensitive surface side of the stacked paper objects;

a heat-recording device which heat-records control information on the heat-sensitive surface of the stacked paper objects which have been transported to the bundling position; and control devices which control the heating temperature of the heater head on both overlapped ends of the bundling material and the pressing time.

9. A paper object processing method comprising:

feeding a paper object in which one surface side is a heat-sensitive surface having information recorded thereon and the other surface side is a non heat-sensitive surface;

conveying the fed paper object;

reading the information recorded on the heat-sensitive surface of the conveyed paper object;

aligning back and front and vice versa for the paper object based on the read information;

stacking the paper objects whose front and back and vice versa have been aligned;

winding the bundling material around the outer periphery of the stacked paper objects at a portion where no information is recorded and overlapping both ends at the non heat-sensitive surface side of the stacked paper objects; and heat-sealing by pressing the heater head on both overlapped ends of the bundling material positioned at the non heat-sensitive surface side of the stacked paper objects by the winding.

* * * * *